US008556136B2

(12) United States Patent
Huynh

(10) Patent No.: US 8,556,136 B2
(45) Date of Patent: Oct. 15, 2013

(54) BEVERAGE SAVER/POURER

(76) Inventor: Chi Huynh, San Dimas, CA (US)

( * ) Notice: Subject to any disclaimer, the term of this patent is extended or adjusted under 35 U.S.C. 154(b) by 0 days.

(21) Appl. No.: 13/253,364

(22) Filed: Oct. 5, 2011

(65) Prior Publication Data

US 2013/0087585 A1 Apr. 11, 2013

(51) Int. Cl.
*B65D 5/72* (2006.01)

(52) U.S. Cl.
USPC ..... 222/500; 222/477; 222/547; 222/566; 222/569

(58) Field of Classification Search
USPC ..... 222/500, 476–477, 481.5, 547, 222/566–567, 569
See application file for complete search history.

(56) References Cited

U.S. PATENT DOCUMENTS

| | | | | | |
|---|---|---|---|---|---|
| 718,801 | A | | 1/1903 | Strauss | |
| 788,118 | A | | 4/1905 | Perotti | |
| 906,381 | A | * | 12/1908 | Hukill et al. | 222/488 |
| 2,113,048 | A | | 5/1936 | Gross | |
| 2,300,053 | A | | 10/1942 | Lubuic | |
| 2,828,054 | A | | 3/1958 | Chiaramonte | |
| 2,991,897 | A | | 7/1961 | Burnett | |
| 3,152,712 | A | | 10/1964 | Riess | |
| 4,473,174 | A | | 9/1984 | Heuser | |
| 4,706,847 | A | | 11/1987 | Sankey et al. | |
| 4,846,378 | A | * | 7/1989 | Kim | 222/479 |
| 5,249,714 | A | | 10/1993 | Merhar | |
| 5,433,354 | A | * | 7/1995 | Jacobsen et al. | 222/495 |
| 5,641,098 | A | | 6/1997 | Roedhus et al. | |
| 5,743,437 | A | * | 4/1998 | Moore et al. | 222/147 |
| 5,911,345 | A | * | 6/1999 | Castleberry | 222/482 |
| 5,924,606 | A | * | 7/1999 | Huizing | 222/500 |
| 5,961,008 | A | | 10/1999 | Peckels | |
| 5,996,860 | A | * | 12/1999 | Alley | 222/564 |
| 6,123,225 | A | | 9/2000 | Peckels | |
| 6,481,601 | B1 | * | 11/2002 | Steen | 222/500 |
| 6,742,678 | B1 | | 6/2004 | Krystopik | |
| D663,172 | S | * | 7/2012 | Huynh | D7/700 |
| D663,593 | S | * | 7/2012 | Huynh | D7/700 |
| 2011/0036873 | A1 | | 2/2011 | Peckels | |

FOREIGN PATENT DOCUMENTS

| | | |
|---|---|---|
| GB | 190403519 | 12/1904 |

* cited by examiner

*Primary Examiner* — Frederick C Nicolas
(74) *Attorney, Agent, or Firm* — Tutunjian & Bitetto, P.C.

(57) ABSTRACT

A beverage pourer/saver having a unique ball stopper mechanism is provided. A ball stopper lifting mechanism is incorporated into the spout of the pourer and is configured so as to allow a ball stopper to operate to both seal the container when not in used, and provide a smooth pouring action during use. The ball stopper lifting mechanism lifts the ball stopper during a pouring action such that the poured liquid can pass under the ball stopper, while simultaneously allowing air to pass over the ball stopper.

8 Claims, 4 Drawing Sheets

BEVERAGE SAVER/POURER

BACKGROUND

1. Technical Field

The present invention relates to beverage dispensing. More particularly, it relates to a device for pouring and sealing the beverage container to which it is releasably attached.

2. Description of the Prior Art

There are many devices known that aid in the pouring of liquids. Some include ball stoppers, and others use the ball as a means to meter the flow of the liquid during pouring. On shortfall present in all of the known devices, is that the ball stopper often interferes with the smooth pouring of the liquid. This is especially true when the liquid is alcoholic, or a sweet drink with a higher than average sugar content.

Generally, in these instances, after a few uses, the sugars in the liquids tend to accumulate on the ball and the chamber within which it is disposed. Once this happens, the ball becomes more of a hindrance than an aid in the pouring of the liquid.

It is therefore an aspect of the invention to provide a beverage saver/pourer that overcomes the shortfalls of the prior art and provides consistent pouring and sealing capability on demand and without the need for constant rinsing and/or cleaning.

SUMMARY OF THE INVENTION

These and other aspects are achieved accordance with an implementation of the present invention which includes a pourer having a pouring spout configured to be connected to a bottle opening. The pouring spout has a pouring opening and further includes a ball stopper positioned within the pouring spout, and a ball stopper lifting mechanism configured to lift the ball stopper during a pouring action such that liquid contained with the bottle passes under the ball stopper during pouring.

According to another implementation, the pourer includes a base configured for releasable air-tight connection to a bottle opening and having an opening in communication with the bottle opening; and a pouring spout integrated with the base. The pouring spout includes a ball stopper positioned to seal the opening in the base when the pourer is not in use. The ball stopper lifting mechanism is configured to lift the ball stopper during pouring such that liquid contained within the bottle can pass under the ball stopper when pouring the liquid from the bottle through the pourer.

According to one implementation, the ball stopper lifting mechanism includes at least one rail configured to receive the ball stopper as the bottle is tilted for pouring. The at least one rail guiding the ball stopper to ride up on the same during a pouring action.

In another preferred implementation, the ball stopper lifting mechanism comprises a V-shaped rail.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Figure 1:
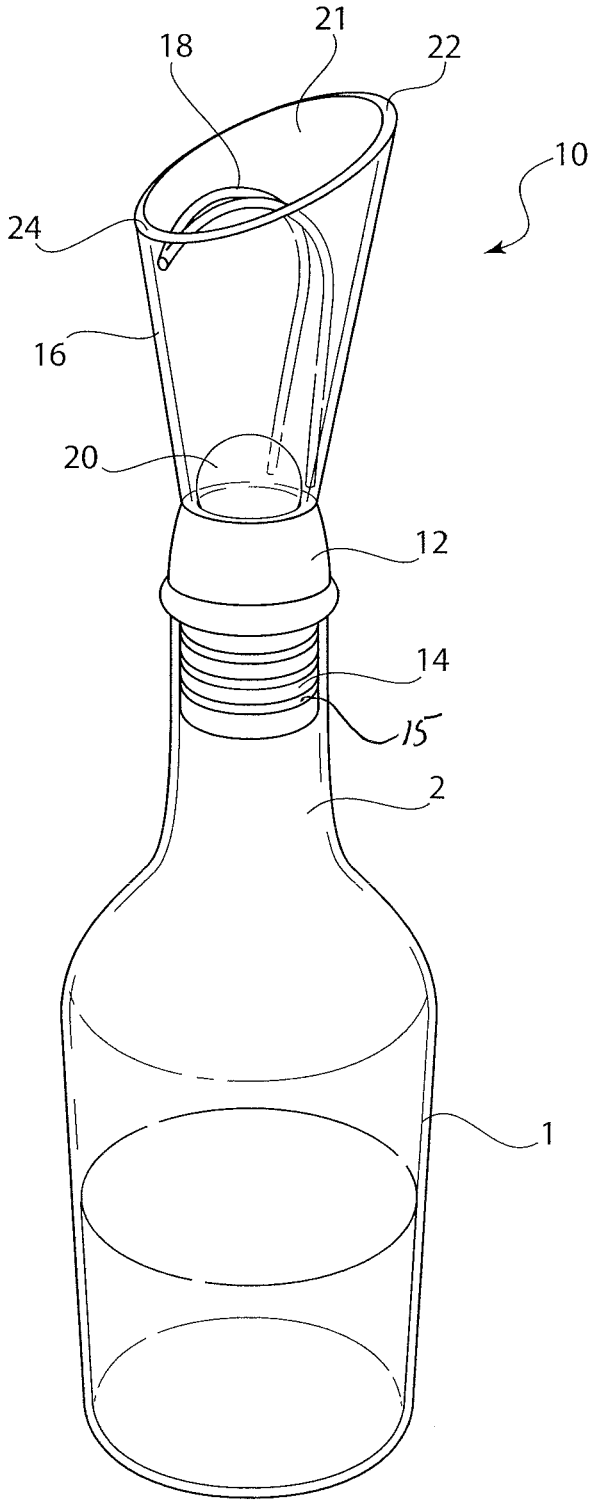
FIG. 1 is a plan view of a Beverage Saver/Pourer according to an embodiment of the invention.
Figure 2:
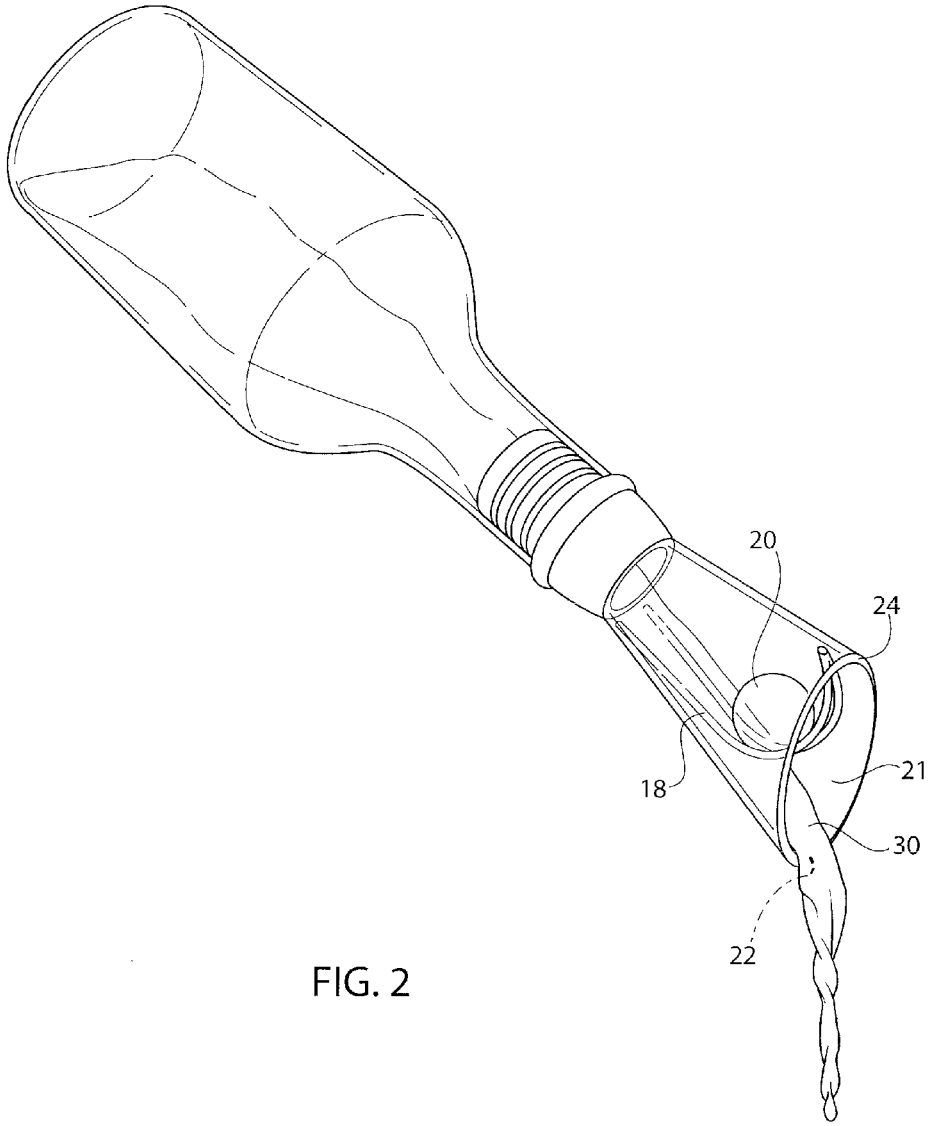
FIG. 2 is a plan view of the Beverage Saver/Pourer shown in use according to an embodiment of the invention.

By way of reference to FIGS. 1 and 2, the pourer/saver 10 of the present invention is configured to include a base 12 having a bottle neck engaging portion 14 as shown in the exemplary embodiment. Although described herein in the context of a wine pourer/saver, it will be appreciated that the bottle 1 with neck 2 can be any beverage container and is not limited to alcoholic beverages.

The bottle neck engaging portion 14 can be configured to have one or more ridges 15 to assist in providing an air tight seal between the bottle neck opening and the bottle neck engaging portion 14. Those of skill in the art understand that other configurations for the bottle neck engaging portion 14 can be implemented without departing from the scope of the present invention. Pourer/saver 10 preferably includes a pouring spout 16 that extends upward from base 12 and has a pouring opening 21 from which the liquid is dispensed.

In FIGS. 1 and 2, the pouring spout is shown as being transparent so the interior of the same is visible. It is to be appreciated that the pouring spout 16 can be made of any suitable material and need not necessarily be transparent as the embodiment shown in FIGS. 1 and 2.

Figure 6:
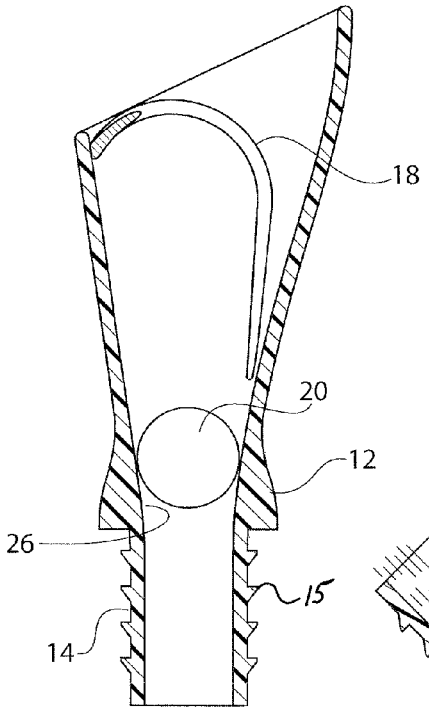
FIG. 6 is a cross-sectional view of the Beverage Saver/Pourer of FIG. 4.
Figure 7:
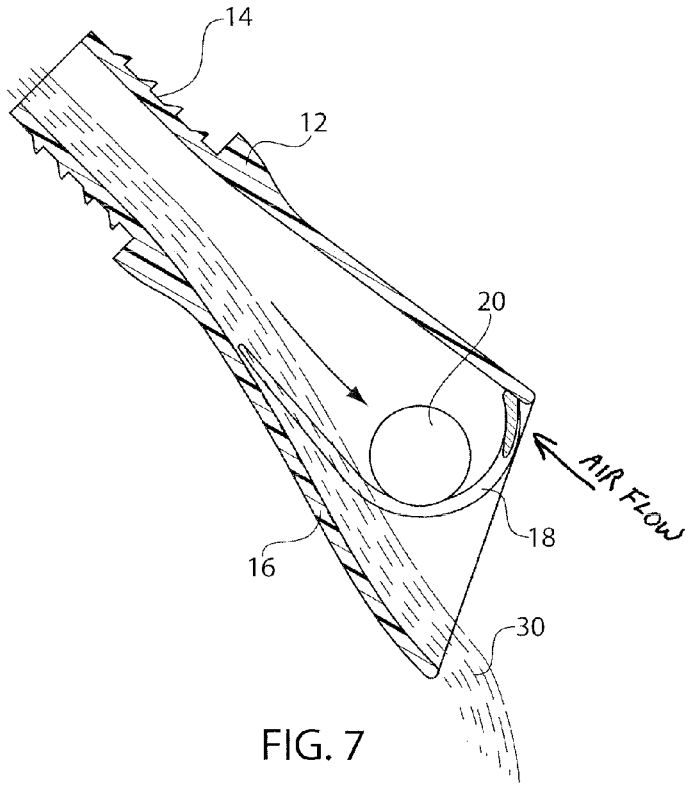
FIG. 7 is a cross sectional view of the Beverage Saver/Pourer of FIG. 2.

Referring to cross sectional views of FIGS. 6 and 7, it will be appreciated that within the pouring spout 16 is ball stopper lifting system 18, and in the present embodiment a rail system 18 that starts at the base of the spout 16 where the same meets the base 12, and extends upward and across the pouring opening 21 as shown. A ball stopper 20 is configured such that when the bottle 1 is not in used, the ball stopper 20 seals an opening 26 in the base 12 and thereby seals the beverage 2 from exposure to the outside air (See, FIGS. 1 and 6). During use, bottle 1 is tilted to pour the liquid 30 therefrom (See FIGS. 2 and 7). This action guides the ball stopper 20 up onto rails 18, so as to take the ball 20 substantially out of the primary flow path of liquid 30 as the same is poured. As can be seen in the exemplary diagrams, by configuring the rails 18 in this matter, not only is the ball stopper 20 substantially removed from the flow path of the liquid enables the liquid 30 to be poured freely while passing under the ball stopper without obstruction, and simultaneously allows for air flow into the bottle over the ball stopper 20, this providing for a very smooth pouring action.

Figure 3:
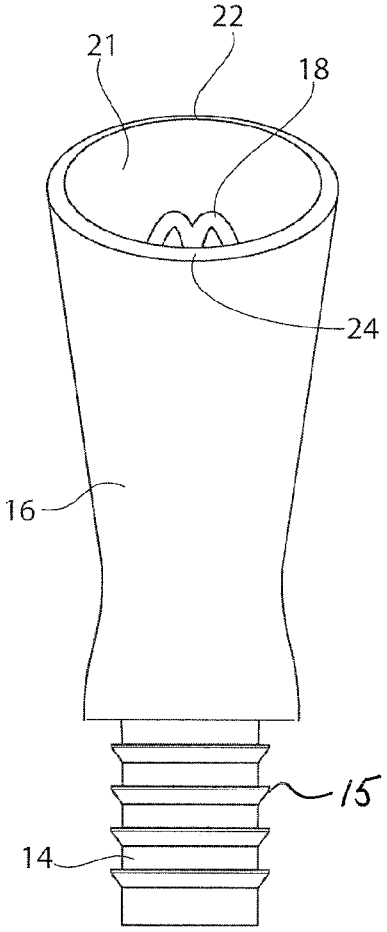
FIG. 3 is a front view of the Beverage Saver/Pourer according to an embodiment of the invention.
Figure 4:
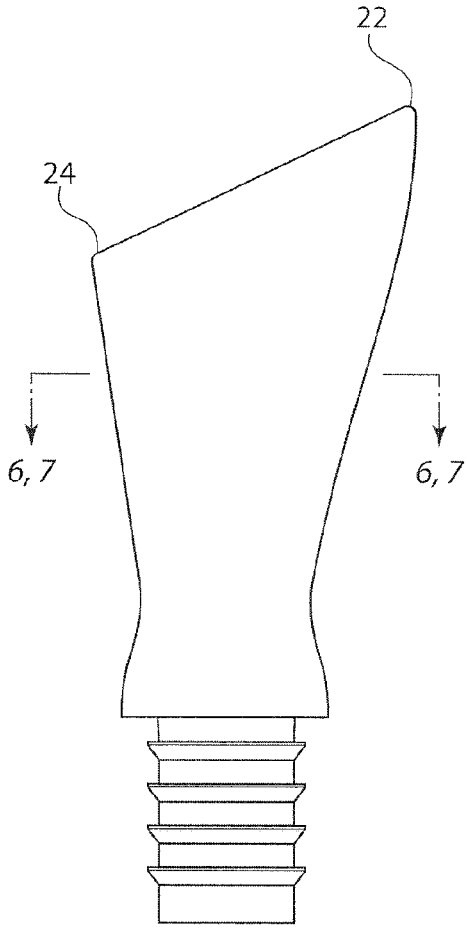
FIG. 4. is a side view of the Beverage Saver/Pourer according to an embodiment of the present invention.
Figure 5:
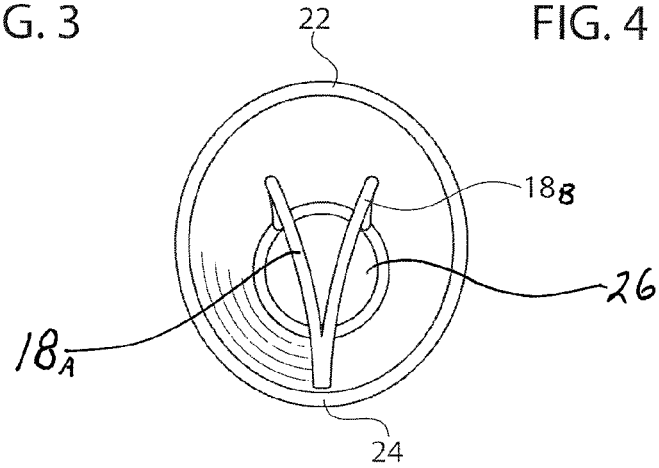
FIG. 5 is a top view of the Beverage Saver/Pourer according to an embodiment of the invention.

FIGS. 3-5 show the preferred implementation of the beverage saver/pourer of the present invention where one side 22 of pouring spout 16 is higher than the opposing side 24. The rail system 18 is configured so as to guide the ball stopper 20 up the rail toward the shorter side 24 while the liquid 30 is poured from the higher side 22.

FIG. 5 depicts the rail system 18 as having two rails 18*a* and 18*b* which start out spaced from each other on the side of opening 26 that is closer to the higher side 22 of shield 16 and converges at a point by side 24 near the top of the spout 16. In this manner, the ball stopper 20 is contained within the pouring shield 16 (so as to not fall out during use or accidentally) and can be guided up the rails 18*a* and 18*b* without concern of the same falling out of the pourer 10.

In the exemplary preferred embodiments shown in FIG. 5, the rail system 18 is configured to contain the ball stopper 20 within the same by having a split rail design or V-shape look from the top view perspective shown in FIG. 5. It is to be appreciated that rail system 18 operates as a ball stopper lifting means and can be implemented in alternative configurations to provide the intended results of lifting the ball stopper out of the beverage liquid path during the pouring action.

Those of skill in the art will appreciate that the materials used to construct the pourer/saver of the present invention can vary depending on design preferences and particular liquids being poured. Examples of such materials, can be, but are not limited to stainless steels, plastics, rubbers, nylon, etc.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A pourer comprising:

a pouring spout configured to be connected to a bottle opening, the pouring spout having a pouring opening and further comprising:

a ball stopper positioned within the pouring spout; and a ball stopper lifting mechanism configured to lift the ball stopper during a pouring action such that liquid contained within the bottle passes under the ball stopper during pouring, said ball stopper lifting mechanism comprising a split rail V-shape configuration having a first end positioned adjacent an opening in a base and two opposing ends extending upward and across the pouring opening in the pouring spout, said ball stopper riding up on said split rail during a pouring action.

2. The pourer according to claim 1, further comprising a base configured to be releasably attached to the bottle opening, the pouring spout being connected to the base.

3. The pourer according to claim 2, wherein said base is releasably connected to the bottle opening.

4. The pourer according to claim 3, where said base provides an air-tight connection.

5. The pourer according to claim 1, wherein the ball stopper operates to close an opening in the base when the pourer is not in use.

6. A pourer comprising:

a base configured to be releasably attached to a bottle opening and having an opening in communication with the bottle opening; and a pouring spout integrated with the base and comprising:

a ball stopper positioned to seal the opening in the base when the pourer is not in use; and a ball stopper lifting mechanism configured to lift the ball stopper during pouring such that liquid contained within the bottle passes under the ball stopper when pouring the liquid from the bottle through the pourer, said ball stopper lifting mechanism comprising a split V-shaped rail having a first end positioned adjacent the opening in the base and two opposing ends extending upward and across an opening in the pouring spout, said ball stopper riding up on said split rail during a pouring action.

7. The pourer according to claim 6, wherein the ball stopper operates to close the opening in the base when the pourer is not in use.

8. The pourer according to claim 6, where said base provides an air-tight connection.

* * * * *